US007097608B2

(12) United States Patent
Merkli

(10) Patent No.: US 7,097,608 B2
(45) Date of Patent: Aug. 29, 2006

(54) SIGNATURE FOLDING DEVICE

(75) Inventor: Peter Merkli, Oftringen (CH)

(73) Assignee: GRAPHA-Holding AG, Hergiswil (CH)

( * ) Notice: Subject to any disclaimer, the term of this patent is extended or adjusted under 35 U.S.C. 154(b) by 66 days.

(21) Appl. No.: 10/108,891

(22) Filed: Mar. 29, 2002

(65) Prior Publication Data

US 2002/0142907 A1 Oct. 3, 2002

(30) Foreign Application Priority Data

Mar. 29, 2001 (EP) ..... 01810320

(51) Int. Cl.
*B31F 1/00* (2006.01)

(52) U.S. Cl. ..... 493/438

(58) Field of Classification Search ..... 493/416, 493/417, 419, 424, 425, 446, 441, 438, 423
See application file for complete search history.

(56) References Cited

U.S. PATENT DOCUMENTS 4,029,310 A * 6/1977 Reist ..... 493/426
4,198,039 A * 4/1980 Bryson et al. ..... 270/52.29
6,305,146 B1 * 10/2001 Gerber ..... 53/116

FOREIGN PATENT DOCUMENTS

| | | |
|---|---|---|
| CH | 615 646 | 2/1980 |
| DE | 37 07 478 | 10/1987 |
| GB | 2 270 306 | 3/1994 |

* cited by examiner

*Primary Examiner*—Scott A. Smith
*Assistant Examiner*—John Paradiso
(74) *Attorney, Agent, or Firm*—Venable LLP; Robert Kinberg; Steven J. Schwarz

(57) ABSTRACT

A folding device for signatures includes a saddle-shaped folding sword having an upright folding edge and an inside guide element below the upright folding edge on which the signatures are folded while passing through the folding device. An outside folding element follows and operates jointly with the inside guide element for folding the signatures.

14 Claims, 5 Drawing Sheets

Fig. 6
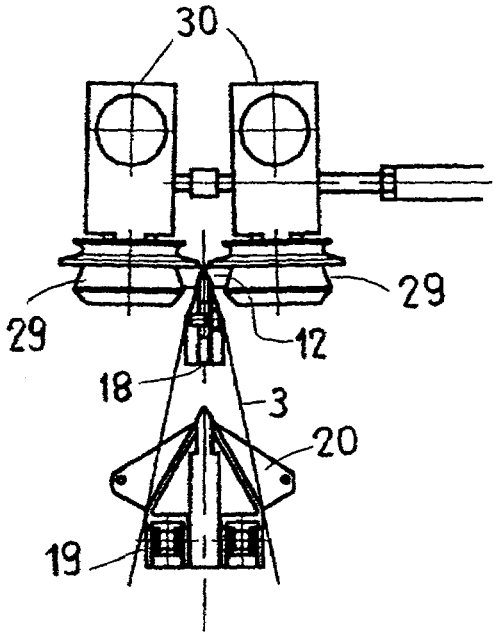
Fig. 7
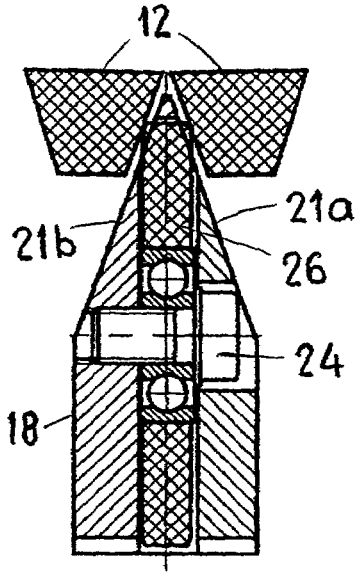
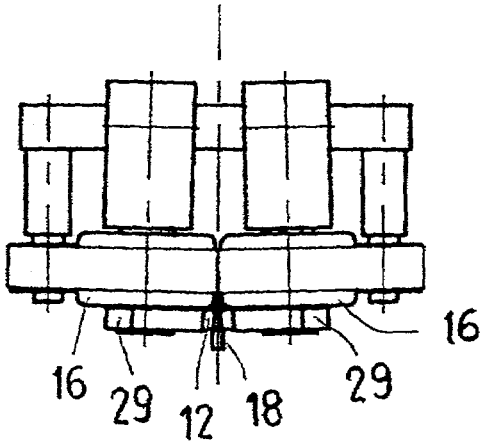
Fig. 8

SIGNATURE FOLDING DEVICE

CROSS REFERENCE TO RELATED APPLICATION

This application claims the priority of European Patent Application No. 01810320.0 filed in the European Patent Office on Mar. 29, 2001, the disclosure of which is being incorporated herein by reference.

BACKGROUND OF THE INVENTION

The invention relates to a signature folding device, comprising a saddle-shaped folding sword with an inside guide element on which the signatures are folded. The device furthermore comprises an outside folding element that follows along and operates jointly with the inside guide element for folding the signatures.

Folding devices of the aforementioned type are known. With these devices, the signatures to be folded are guided onto a stationary folding sword and are folded thereon while passing through, with the aid of the outside folding element that follows. Belts, round strings, V-belts or chains, for example, can form the folding element that follows. A folding design of this type has the particular disadvantage that the folding occurs only gradually and that the signatures do not fit form-fittingly against the folding sword until the end of the folding operation. Only at the end of this folding operation are the signatures held securely in place and can thus be transported without slipping. Prior to this, the signatures are quite unstable and can deviate from the predetermined course, thus resulting in an inexact folding. Another difficulty is that the signatures to be folded are slowed down on the inside, by the folding sword that is stationary, and at best have a tendency toward smearing. The higher the effect of the outside folding element, the higher the tendency to smearing.

The folding element on the inside is, for example, a chain with fitted-on roof-shaped elements or is formed by round strings.

A folding device as defined in the preamble is disclosed in Swiss Patent document CH 615 646 A. The inside folding element described in this document is formed by a linear row of folding rollers. On the one hand, the folding element on the inside should be a precision element, so that a sharp, closed and if possible complete fold can be formed. On the other hand, this folding element should also be robust to prevent the element from being bent or damaged during backups, which requires a certain structural size. These two requirements conflict with each other, so that compromises are necessary in the one or the other direction. If the folding element on the inside consists of rollers, arranged one behind the other as specified in the Swiss Patent, the difficulty arises that during the folding process the front edges of the signatures to be folded must repeatedly run in via the subsequent roller. If the signatures to be folded are not always positioned exactly the same way for the run in, the resulting fold is not sharp and the folding accuracy cannot meet high requirements. A precise run in of the signatures onto the rollers is difficult to realize since stresses in the signatures to be folded are hard to avoided during the process of folding the signatures while they are passing through.

SUMMARY OF THE INVENTION

Thus, it is an object of the invention to provide a folding device of the aforementioned type, which permits a more precise folding, but which can nevertheless be produced easily and cost-effectively and is robust.

The above and other objects are accomplished according to the invention by the provision of a folding device for signatures, comprising: a saddle-shaped folding sword including an upright folding edge and an inside guide element below the upright folding edge on which the signatures are folded while passing through the folding device; and an outside folding element that follows and operates jointly with the inside guide element for folding the signatures.

With this type of folding device, a precise, saddle-shaped and continuous folding line can be formed at the folding sword. The inside guide element is arranged at the location where the outside folding element grips and transports the signature. As a result, the signature to be folded is guided definitively and continuously and the signatures are prevented from slipping off the folding sword, which is undesirable.

According to a modification of the invention, the inside guide element is designed so that it projects from the guide surfaces on the side of the folding sword. As a result, the side regions in which the signatures are guided can be exactly determined. If, according to another modification of the invention, the folding sword is tapered in the movement direction, at least in a frontal area, the signatures can be mostly closed and the folding sword can still have a robust design. Several rollers aligned in a row advantageously form the guide element on the inside. These are preferably arranged such that they project with at least one outside edge on the side at the guide surfaces of the folding sword. A particularly good guidance is achieved if the roller surface on at least one edge is essentially parallel to one guide surface on the side of the folding sword.

According to another modification of the invention, two strands, preferably two V-belts, form the outside folding element that follows.

A particularly stable guidance of the signatures is achieved if these V-belts are not simply adjusted to feed to the folding sword, but if they are twisted along the folding sword, in accordance with the feeding. This results in a very stable guidance of the signatures during the folding operation, which are stretched over the edge of the folding sword. The signatures consequently have a stable guidance over the complete region of the folding sword and are effectively prevented from sliding off or otherwise deviating from the predetermined path.

BRIEF DESCRIPTION OF THE DRAWINGS

Further advantageous features follow from the dependent patent claims, the following description and the drawing.

One exemplary embodiment of the invention is explained in further detail in the following with the aid of the drawing, in which:

FIG. 6 is a sectional view along the line VI—VI in FIG. 2.

FIG. 7 is a cross-sectional view through the folding sword and the outside folding element.

FIG. 8 is a view of the folding sword in the direction of arrow VIII in FIG. 2.

DETAILED DESCRIPTION OF THE INVENTION

Figure 1:
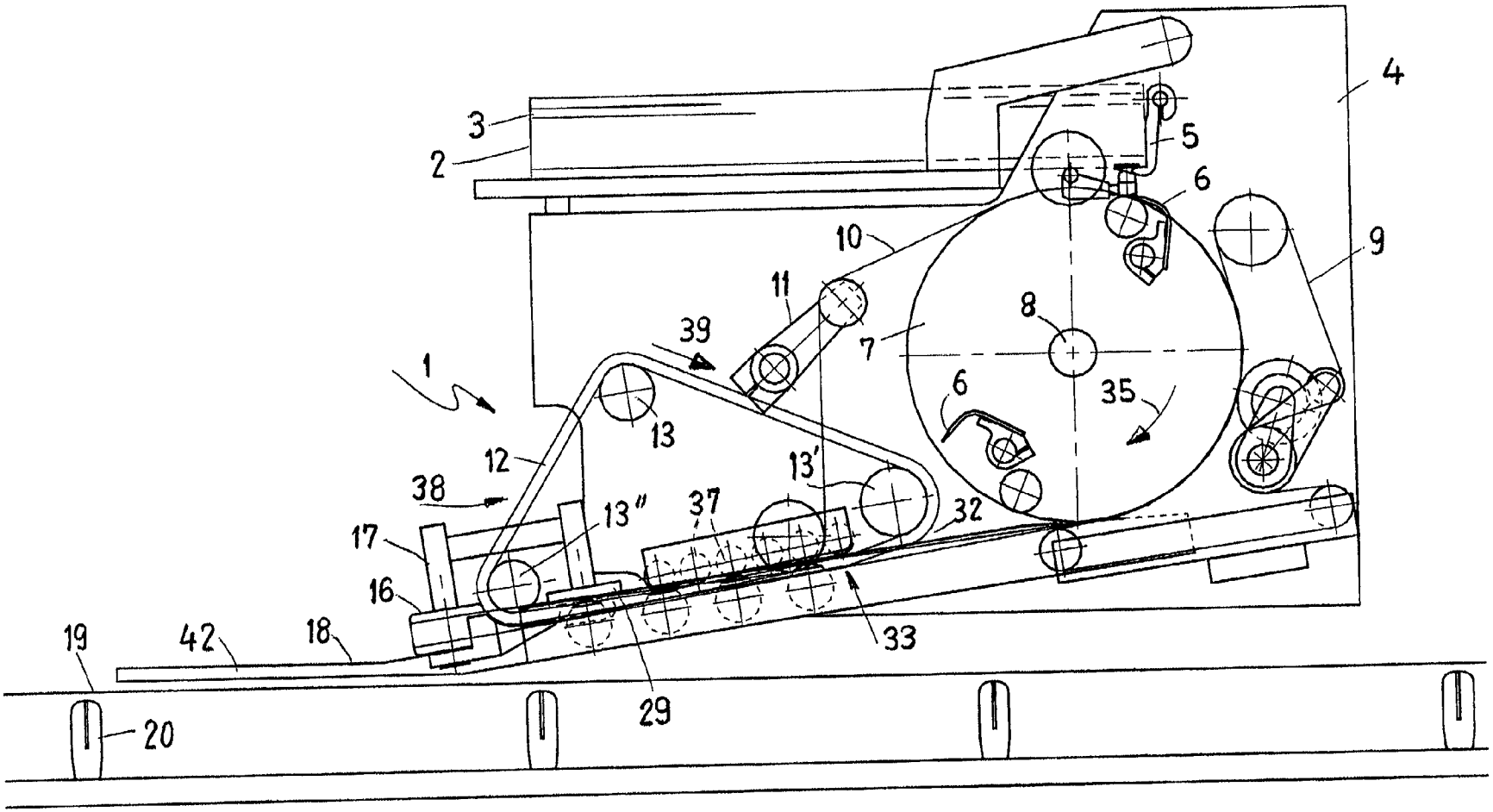
FIG. 1 is a schematic view from the side of a folding device according to the invention.
Figure 2:
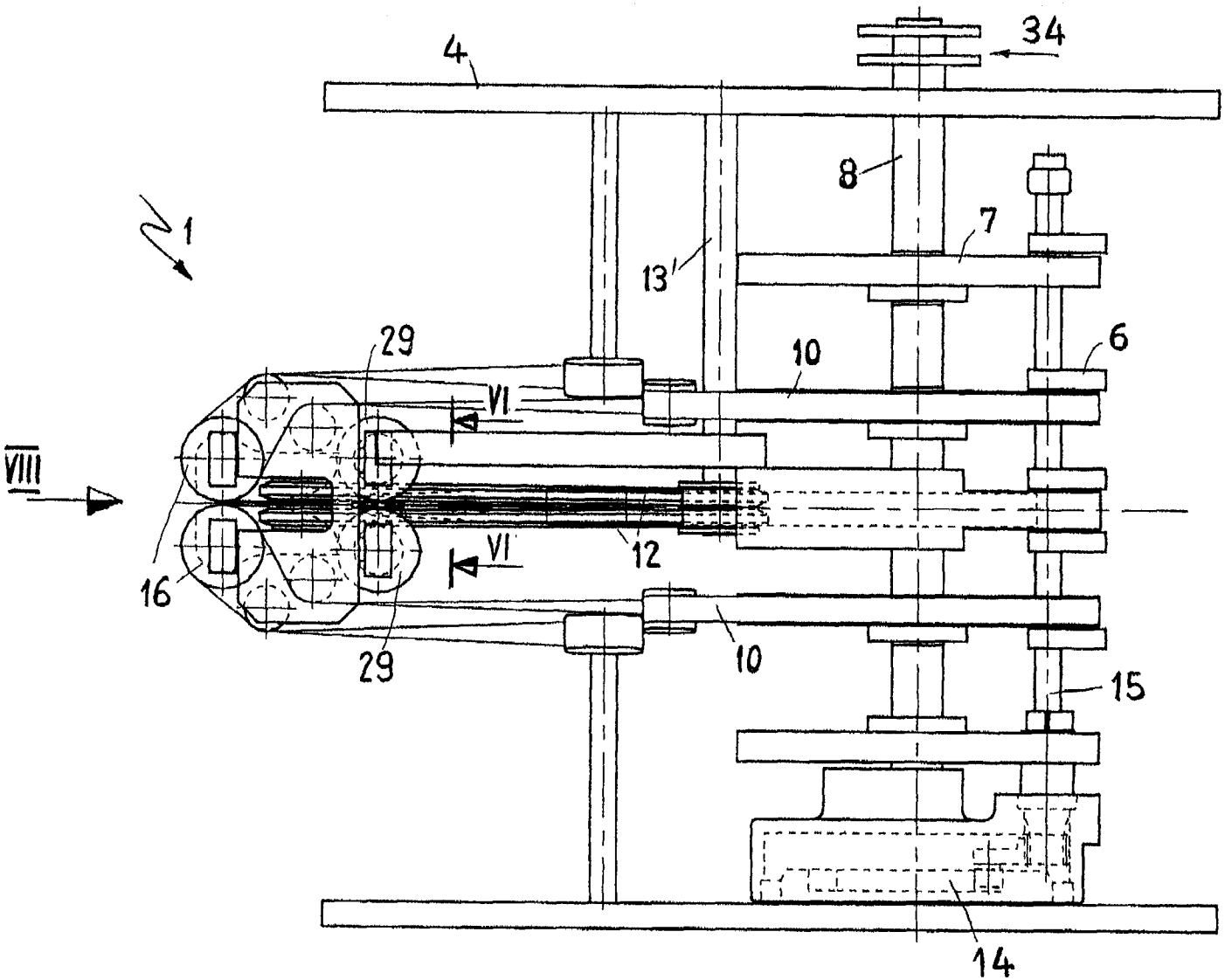
FIG. 2 is a different view of the folding device according to FIG. 1, wherein parts are left out for drawing reasons.

Referring to FIG. 1, signatures 3 to be folded are initially stacked one above the other to form a stack 2. The lowest signature 3 is respectively tilted with the aid of a suction device 5 from the stack 2 into a gripping region of a gripping drum 7. Gripping drum 7 has grippers 6 that respectively grip one tilted signature 3 and pull this signature from stack 2. The pulled-off signature 3 can be notched with the aid of a notching wheel, not shown herein, or can be otherwise weakened or processed, for example by moistening it, in order to prepare the fold. The pulled-off signatures 3 are respectively guided individually with the aid of transfer belts 9 and 10 to a run-in 32 of a folding section 33. A folding sword 18, two endless strands 12 and two pressing rollers 16 essentially form folding section 33.

A shaft 8 drives gripper drum 7 in the direction of arrow 35 and a drive element 34 drives the shaft 8. The transfer belts 10 are driven by the gripper drum 7 and are guided so that they in turn drive pressing rollers 16 and two guide rollers 29. The drive element 34 drives a wheel 13', which in turn drives the strands 12. This ensures a synchronized operation of gripper drum 7 with pressing rollers 16 and the two strands 12. Tension for feed belts 10 can be adjusted with a lever 11.

Figure 3:
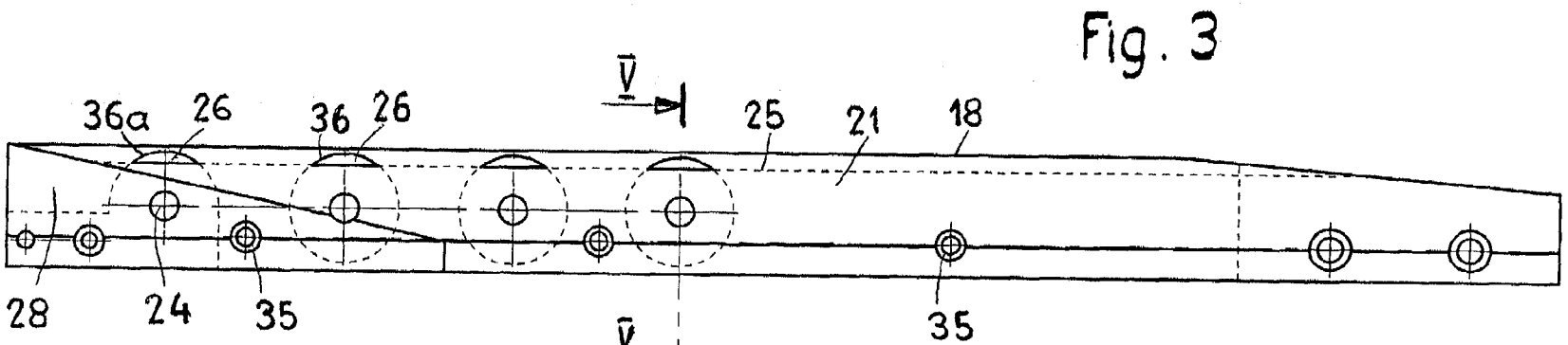
FIG. 3 is a view from the side of the folding sword.
Figure 4:
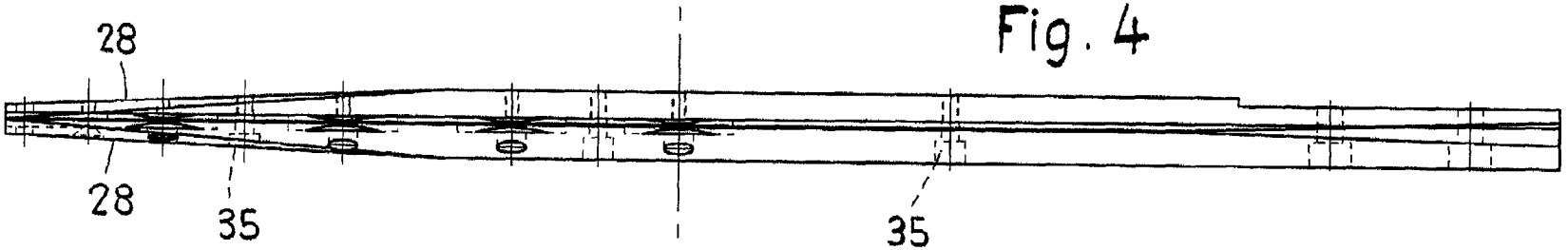
FIG. 4 is a view from above of the underside of the folding sword.
Figure 5:
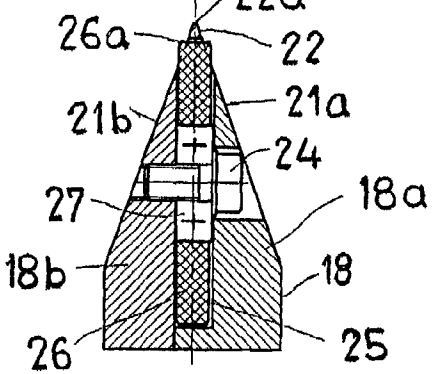
FIG. 5 is a sectional view along the line V—V in FIG. 3.

FIGS. 3 to 5 show that folding sword 18 consists of two halves 18*a* and 18*b*, which are fitted together and are detachably connected with screws 35. Recesses 25, in which respectively one roller 26 is positioned, are left open between the two halves 18*a* and 18*b*, wherein the rollers 26 are arranged in a row. They are positioned by screwing a head screw 24 into the half 18*a* or 18*b*, as well as with a pivoting bearing 27. Respectively below a folding edge 22, these recesses 25 are provided with a circular-segment shaped window 36 for each roller 26, as shown in FIG. 3. These windows 36 are respectively located in the upper region of a guide surface 21*a* or 21*b*, which is slanted relative to a vertical line. An upright standing (uninterrupted), comparatively sharp folding line 22*a* is formed by the folding edge 22. This folding line extends over the complete folding section 33. The folding edge 22 forms an isosceles triangle in the cross section. The outside edges 26*a* of rollers 26 project over respectively one guide surface 21*a* or 21*b*. According to FIGS. 9 and 10, they form side surfaces 31 in this region, which are parallel to the guide surfaces 21*a* or 21*b*. The rollers 26 thus extend with their edges through the windows 36 and to the outside of the folding sword 18, thereby projecting over the guide surfaces 21*a* or 21*b*. The distance between these side surfaces 31 and the guide surfaces 21*a* or 21*b* is comparatively small, for example 0.5 mm. FIGS. 3 and 4 show that the rollers 26 and the windows 36 are arranged in the front half of the folding sword 18. The front window 36*a*, as seen in the movement direction, is located in the region of two opposite-arranged surfaces 28, which taper the folding sword 18 at the front end, as shown particularly clearly in FIG. 4.

For the folding operation, the rollers 26 operate jointly with the two strands 12, which form an outside folding element 38 together with the deflection rollers 13, the guide rollers 29 and additional guide rollers 37. The two strands 12 are preferably V-belts, for example having the trapezoid cross-sectional shape shown in FIG. 7. However, the strands 12 can also be round strings, belts or chains for example. As previously explained, the two strands 12 are driven synchronously with the transfer belts 9 and 10. As indicated in FIG. 1, the arrow 39 shows the movement direction for the two strands 12. The deflection roller 13' deflects the two strands 12 toward the folding section 33. The strands 12 leave this folding section 33 again at roller 13". The guide rollers 37 are arranged in the region of folding section 33, such that the two strands 12 are adjusted for feeding the folding sword 18, as shown in FIGS. 9 and 10.

Figure 9:
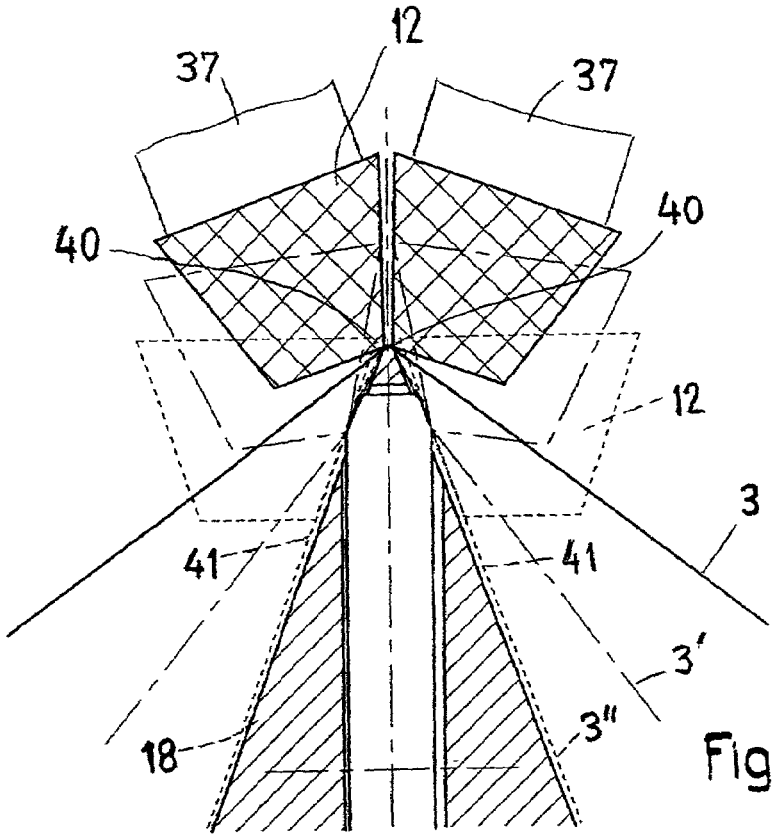
FIGS. 9 and 10 are schematic views showing a feeding to the outside folding element.

For the preferred feeding method according to FIG. 9, the two strands 12 are twisted in the longitudinal direction in the region of folding section 33. According to the cross-sectional view shown with drawn-out lines, the two strands 12 are twisted directly behind the run-in 32 so that in the region of folding line 22*a*, they fit with their lower edges 40 elastically against the folding edge 22. A signature 3 to be folded is thus guided at the folding line 22*a* in the region where a fold is to be formed. The frictional surface is comparatively small since the signatures 3 in this case are opened up comparatively wide and the folding edge 22 is comparatively sharp in the region of folding line 22*a*. During the further course, the two strands 12 travel downward with the aforementioned edges 40, respectively diametrically opposed to each other, and move initially to the position indicated in FIG. 9 with a dash-dot line. As can be seen, the edges 40 move to the region of surfaces 31 and, in the process, fold the signature 3 around the folding line 22*a*. The correspondingly folded signature 3' is also indicated with a dash-dot line at this location. Finally, the strands 12 reach the position shown with dashed line. In this position, the two strands 12 are also pressed elastically against the surfaces 31 of the respective rollers 26. Between the surfaces 41 and the surfaces 31 of rollers 26, the signature 3" is held in place and carried along by the pressing force of the two strands 12. The rollers 26 passively rotate along in this case. Since the surfaces 31 project relative to the guide surfaces 21*a* or 21*b*, as explained in the above, the friction of the signature 3" along the side surfaces 21*a* and 21*b* is comparatively low, but the signature is nevertheless always securely guided. It is essential that the signature 3 is guided right from the start of folding section 33 by the edges 40. The signature 3 to be folded is thus transported in a straight line and without essentially deviating from the course in the region of folding section 33 and a precise folding line is thus formed.

Figure 10:
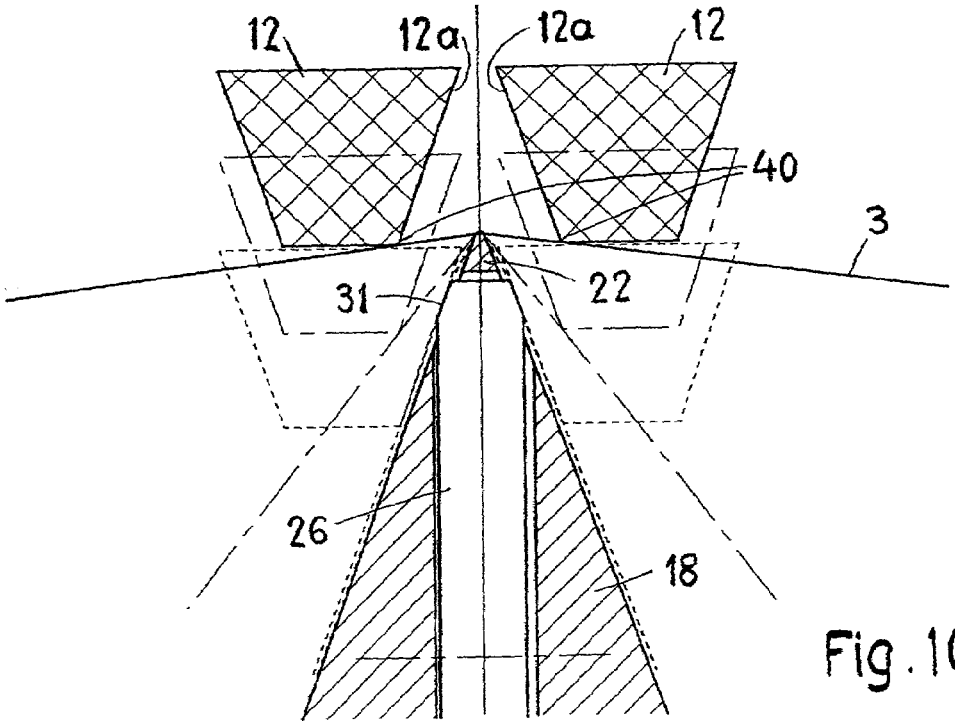

According to FIG. 10, the two strands 12 are not twisted for the feeding and, as can be seen, move without twisting around their longitudinal axis from the top to the bottom. The lowest position, shown with dashed lines, corresponds to the lowest position according to FIG. 9. However, shortly after the run-in 32, the edges 40 of strands 12 are comparably far removed from the folding edge 22. The signature 3 in this case is not pressed elastically against the folding edge 22 and, accordingly, the signature 3 is guided to a lesser degree than in FIG. 9. The feeding according to FIG. 10 is a variant of the invention. However, it can be improved if the width and the contact surfaces of rollers 26 are adapted to the outside folding elements, for example, so that the width of roller 26 decreases in the paper movement direction. In the region of deflection roller 13, the strands 12 are lifted off the folding sword 18. The folded signatures 3 are then moved between the two pressing rollers 16 and are closed by these rollers. The signatures 3 subsequently are moved onto the horizontally extending tongue 42, shown in FIG. 1, and are there gripped by carriers 20 of a collecting chain 19. After leaving the tongue 42, they are deposited on the collecting chain 19 and are moved with this chain to an additional processing station that is not shown herein. The tongue 42 and the collecting chain 19 are not required and can be replaced with other transport means.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A folding device for signatures, comprising:

a saddle-shaped folding sword including an upright folding edge and an inside guide element below the upright folding edge on which the signatures are folded while passing through the folding device; and an outside folding element that follows along the folding sword and presses at least a portion of the signatures against the inside guide element to fold the signatures over the upright folding edge.

2. The folding device according to claim 1, wherein the folding sword includes inside guide surfaces and the inside guide element extends outward from the inside guide surfaces.

3. The folding device according to claim 1, wherein the folding sword is tapered in a movement direction of the signatures.

4. The folding device according to claim 1, wherein the inside guide element comprises a plurality of rollers.

5. The folding device according to claim 4, wherein the folding sword includes inside guide surfaces each having a side and the rollers each have at least one outside edge that projects beyond the side of one of the inside guide surfaces.

6. The folding device according to claim 5, wherein at least the outside edge includes a surface which extends essentially parallel to an adjoining guide surface.

7. The folding device according to claim 6, wherein the outside folding element comprises at least two endless strands which fit elastically against the folding sword.

8. The folding device according to claim 7, wherein the outside folding element includes guide means, which push the strands elastically against the inside guide element.

9. The folding device according to claim 8, wherein the strands are V-belts.

10. The folding device according to claim 9, wherein the strands are twisted in a longitudinal direction around their longitudinal axis at least in a folding region of the folding device.

11. The folding device according to claim 10, further including pressing rollers arranged after the folding sword, as seen in a movement direction of the signatures, between which the signatures are further closed.

12. The folding device according to claim 1, wherein the folding sword has openings on the inside guide surfaces, the openings being arranged immediately below the folding edge and through which the inside guide element extends toward the outside.

13. The folding device according to claim 12, wherein the openings have a circular-segment shape.

14. The folding device according to claim 13, wherein the openings are arranged in a row one after another.

* * * * *